US005199774A

United States Patent [19]

Hedinger et al.

[11] Patent Number: 5,199,774

[45] Date of Patent: Apr. 6, 1993

[54] COMBINATION LOCK AND INTERLOCK FOR A FILE CABINET

[75] Inventors: Paul R. Hedinger, Jasper; Steven F. Trinkel, Rockport; David L. Hostetter, Jasper, all of Ind.

[73] Assignee: Kimball International, Inc., Jasper, Ind.

[21] Appl. No.: 618,468

[22] Filed: Nov. 27, 1990

[51] Int. Cl.[5] ..... F05B 65/46; F05B 7/06

[52] U.S. Cl. ..... 312/219; 312/221

[58] Field of Search ..... 312/216–221

[56] References Cited

U.S. PATENT DOCUMENTS

| | | | |
|---|---|---|---|
| 1,238,514 | 8/1917 | Hartbeck . | |
| 3,360,318 | 12/1967 | Studinski | 312/217 |
| 3,589,783 | 6/1971 | Studinski | 312/217 |
| 3,799,638 | 3/1974 | Faiks | 312/216 |
| 3,941,441 | 3/1976 | Scheerhorn | 312/215 |
| 3,957,324 | 5/1976 | Klenik et al. | 312/221 X |
| 3,969,008 | 7/1976 | Pergler | 312/221 |
| 4,298,236 | 11/1981 | Laroche | 312/215 |
| 4,355,851 | 10/1982 | Slusser | 312/215 |
| 4,429,930 | 2/1984 | Blouin | 312/216 |
| 4,469,382 | 9/1984 | Slaats, et al. | 312/219 |
| 4,480,883 | 11/1984 | Young | 312/220 |
| 4,711,505 | 12/1987 | Lakso | 312/220 |
| 4,768,844 | 9/1988 | Ludwig | 312/221 |
| 4,770,476 | 9/1988 | Lakso | 312/220 |

FOREIGN PATENT DOCUMENTS 2079834 6/1980 United Kingdom .

*Primary Examiner*—Peter R. Brown

*Attorney, Agent, or Firm*—Baker & Daniels

[57] ABSTRACT

A cabinet assembly having a plurality of vertical rows of drawers. A combination lock and interlock system is provided wherein a cable having a predetermined slack is positioned adjacent the plurality of drawers and interacts with a catch that is positioned on each drawer. Upon opening of a drawer, the catch moves the cable from a slack position which permits a drawer to be opened to a taut position which prevents the opening of a second drawer. One end of the cable is attached to a remote locking device which selectively pulls the cable taut and releases it to a slack position to allow remote locking and unlocking of all drawers while in their closed positions.

26 Claims, 4 Drawing Sheets

COMBINATION LOCK AND INTERLOCK FOR A FILE CABINET

BACKGROUND OF THE INVENTION

The present invention relates generally to filing cabinets having drawer locking mechanisms for preventing the opening of drawers in the cabinet under certain conditions. More particularly, the invention relates to a filing cabinet having a remote locking device for locking drawers as a security measure in combination with an interlock mechanism which prevents the opening of more than one drawer at a time.

Conventional filing cabinets generally contain two or more horizontally sliding drawers to store files or other materials. With such filing cabinets, the opening of two or more drawers at one time may cause the cabinet to topple over. This is especially a problem when one file drawer is heavily loaded. Furthermore, the weight of an open cantilevered drawer may cause the cabinet to lean forward to an extent that the other drawers, due to gravity, slide from their closed to open positions, thereby causing the cabinet to tip over.

In order to prevent tipping of a cabinet, interlock mechanisms have been provided to prevent a second drawer of the cabinet from being opened after a first drawer has been opened. A common type of interlock system provides a vertically disposed latch bar that is positioned adjacent each drawer. As the drawer is opened, the latch bar moves into a position to prevent the other drawers from opening while the withdrawn drawer remains open. A problem experienced with this type of arrangement is that if two or more drawers are simultaneously moved to an open position, the latch bar can sometimes operate in the same manner as if one drawer is open. Therefore, no restraining effect on any of the moving drawers occurs, thereby resulting in possible tilting or tipping of the cabinet. This can be controlled to some extent by appropriate manual operation of the drawers, but if the files are improperly leveled and subject to vibrations, for example from adjacent machinery, the vibrations can induce simultaneous movement of several of the drawers to an open position to cause the file cabinet to tip over.

In addition to latch bars, other types of interlocking arrangements have been used. For example, the drawers may include channels which receive rollers secured to a vertically shiftable bar carried on the sides of the cabinet. In this arrangement, when one drawer is open, the roller displaces the vertical bar so that the rollers on the remaining drawers are no longer in registry with the channels on the bar. In this manner, the opening of a second drawer is prevented. Another type of interlock system includes the use of straps on the back surface of the drawers which engage vertical bars having corresponding locking portions. The vertical bars engage the strap at the back of the cabinet to prevent opening of a second drawer when a first drawer is open.

A problem with these systems is that the interlocking mechanisms are so critically aligned that there is no compensation for adjustments due to various loads on the cabinet. First, the bars or rods must be carefully aligned, which is often a time consuming procedure. In addition, the bars must be mounted at several locations on the drawer, which increases the chances of improper assembly. Further, these devices usually require a spring device that retains the bar in its position when the drawer is open. If the cabinet is bumped or jarred and a bar is misaligned, the cabinet essentially becomes inoperative. Problems may also occur in shipping. For example, if a cabinet is shipped, and the individual drawers are in an unlocked position, the bars can become misaligned so that the cabinet arrives at its destination in an inoperative condition.

Another type of interlock system uses a cam system. In these systems, a cam member is engaged and rotated as a drawer is opened to displace a stop mechanism (i.e. bar, belt, ballbearing, rod, rope, cable, etc.). One type of cam system utilizes a safety latch having vertical latch bars and rollers which cooperate with cam members attached to the sides of the drawers. When the drawer is moved, the cam member is displaced towards the roller so that the roller engages a cam surface on the latch bar and displaces the latch bar. The latch bar is then maintained in a displaced position to resist movement of a second drawer. Another type of cam system uses a ribbon or cable that is connected between the drawers and support on the frame of the cabinet. The cable has a predetermined slack which is taken up when the drawer is fully extended.

One problem with many of these cam systems is that the camming member utilizes a spring-biased detent, which holds the camming member in position while the drawer is open. However, if a drawer is partially open and the cabinet is moved or bumped before the force of the spring is overcome, the cam may rotate back to its closed position and prevent the drawer from being closed. In addition, another drawer may be opened.

Along with the problem associated with the spring biased camming member is that the cam systems are limited to use exclusively as an interlock. In order to lock the drawers for security reasons, an additional locking device is required.

It is desired to provide a drawer locking system in which both the interlock system and the remote lock system operate together. In addition, it is desired to provide a camming mechanism which avoids the problems associated with a spring loaded detent.

SUMMARY OF THE INVENTION

The present invention provides a cabinet having a cable lock and interlock system, wherein a cable extends adjacent a plurality of drawers and interacts with a trip member or catch attached to each drawer such that, upon opening of a drawer, the catch moves the cable from a slack position which permits a drawer to be opened to a taut position which prevents the opening of a second drawer. One end of the cable is attached to a remote locking device which selectively pulls the cable taut and releases it to a slack position to allow remote locking and unlocking of all the drawers, while in their closed positions.

Generally, the invention provides a cabinet including a cable extending adjacent a plurality of drawers and attached to the frame of the cabinet. A catch is positioned on each drawer to interact with the cable. The cable has a predetermined slack which is taken up when the catch on the drawer interacts with the cable when the drawer is opened thus pulling the cable to a taut position. The taut position prevents the opening of a second drawer. A remote locking system is also provided on the cabinet and is secured to the cabinet frame to take up slack in the cable so that all of the drawers may be selectively locked in their closed positions for security purposes.

Specifically, the invention provides such a cabinet in which a cam is positioned adjacent each drawer and in the path of the catch on the drawer so that, upon opening the drawer, the catch engages the cam which then moves the cable from a slack position to a taut position. The end of the cable is attached to a small lock cylinder to allow selective remote locking of all drawers. Upon rotation of the cylinder, the attached cable is wound around the cylinder to pull the cable to a taut position.

An advantage of the combined locking mechanism of the present invention is that a combined drawer interlock system and remote locking system is provided in which the remote locking system engages the stop member without an additional intermediate device.

Another advantage of the locking system of the present invention is that the camming mechanism rotates between open and closed positions without requiring a spring-biased detent.

Another advantage of the locking system of the present invention is that the drawer locking system is easily adjustable and may be accurately installed and adjusted according to various climate and load conditions.

A further advantage of the locking system of the present invention is that only one drawer may be opened at a time and two drawers cannot be opened simultaneously.

The invention provides, in one form thereof, a cabinet having at least two drawers in which each drawer has a closed position and an open position. A cable extends adjacent each drawer for preventing outward movement of the drawer. The cable is moveable between a slack position to allow outward movement of any one of the drawers and a taut position to prevent outward movement of any of the drawers. A catch is attached to each of the drawers for engaging and moving the cable from the slack position to the taut position upon outward movement of one of the drawers. Therefore, only one drawer may be in an open position at any one time. A remote locking device is attached to the cable for selectively moving the cable between the slack position and the taut position while each drawer is in its closed position.

DESCRIPTION OF THE PREFERRED EMBODIMENT

Figure 1:
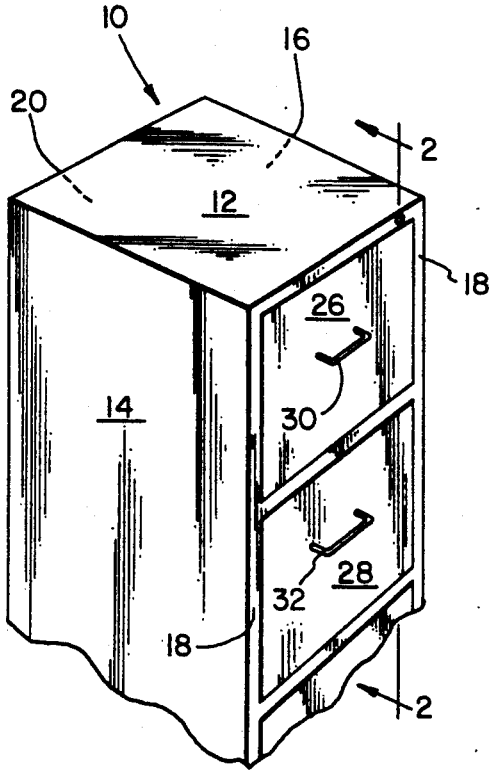
FIG. 1 is a fragmentary, front perspective view of a file cabinet of the type in which the drawer lock mechanism of the present invention can be incorporated.
Figure 2:
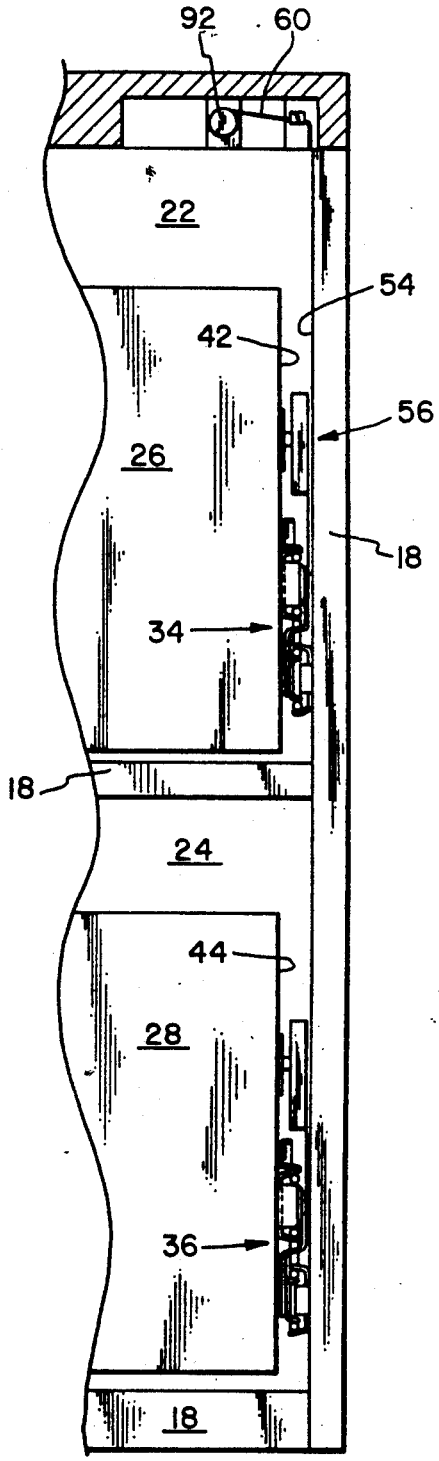
FIG. 2 is an enlarged fragmentary front partial sectional view of the cabinet taken along line 2—2 of FIG. 1.

Referring to FIG. 1, there is illustrated a typical lateral file cabinet 10 in accordance with the present invention. The cabinet includes a top panel 12, side panels 14 and 16, front panel 18, back panel 20 and a bottom panel (not shown). Front panel 18 includes openings 22 and 24 to allow the insertion of drawers 26 and 28, respectively, in cabinet 10. Drawers 26 and 28 include respective handles 30 and 32 and further include respective conventional drawer slide mechanisms 34 and 36 to mount drawers 26 and 28 in cabinet 10. Although not shown, cabinet 10 may be a lateral file in which the door of each cabinet is conventionally pivoted upwardly or downwardly and then slid rearwardly into the cabinet to a recessed horizontal position. Further, although only two drawers are illustrated, the invention also includes cabinets having more than two drawers.

Figure 3:
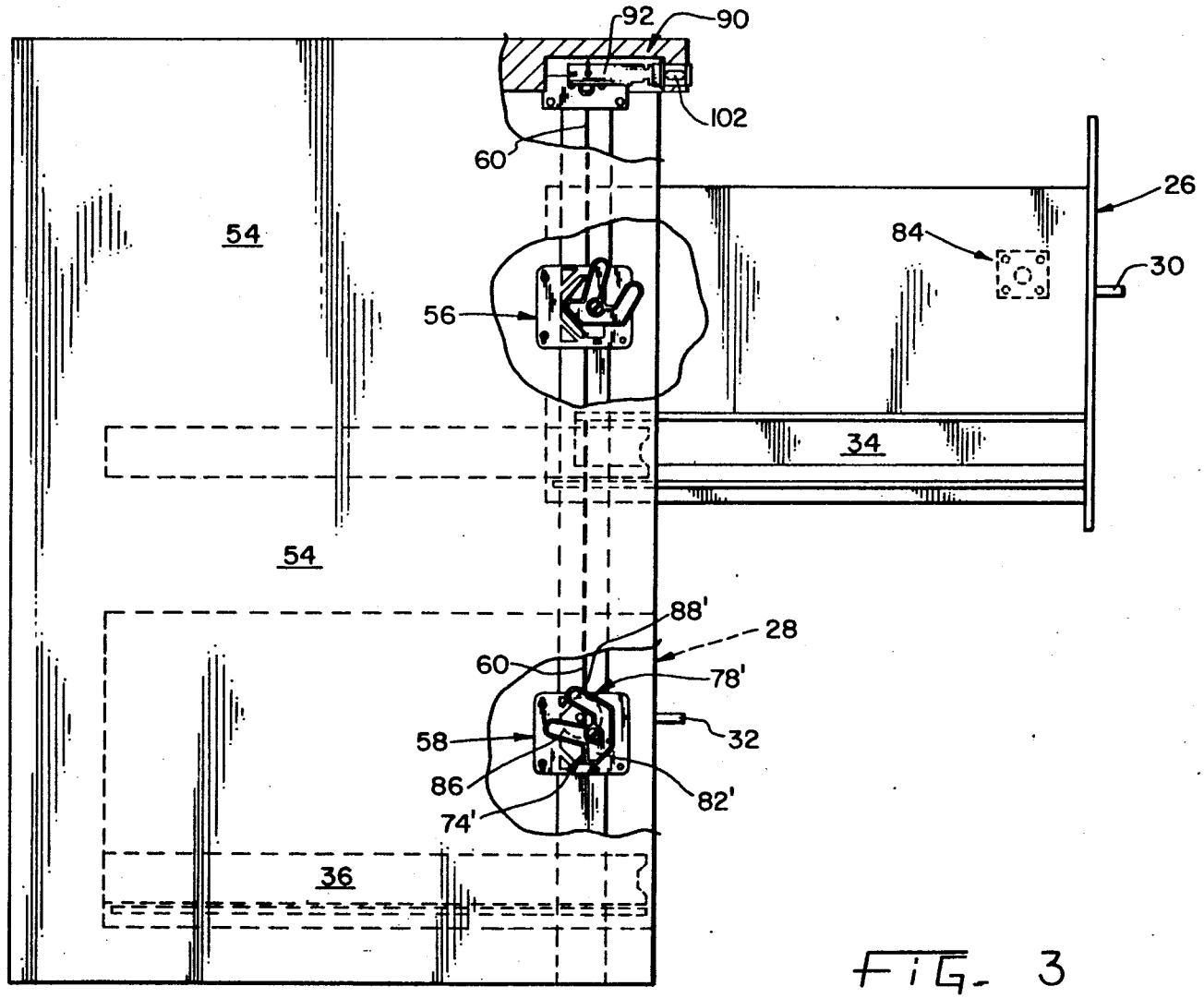
FIG. 3 is an enlarged, side view of the cabinet of FIG. 1, particularly showing the top drawer in its open position and the bottom drawer in its closed position wherein portions are broken away to illustrate the details of the interlock.

As best shown in FIG. 3, cabinet 10 includes identical cam mechanisms 56 and 58, which are mounted in a vertical line on inner surface 54 of side panel 16. Each cam mechanism is associated with a drawer of the cabinet and is secured to surface 54 just above a corresponding drawer slide as shown in FIG. 3. A flexible cable 60, preferably made of stainless steel, extends the height of cabinet 10 through cam mechanisms 56 and 58.

Figure 3A:
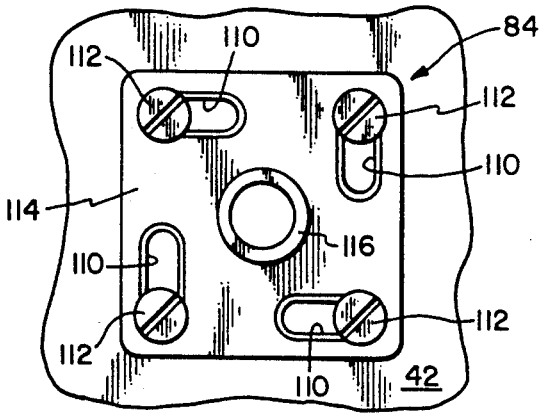
FIG. 3A is an enlarged side view of the trip member according to the present invention.
Figure 3B:
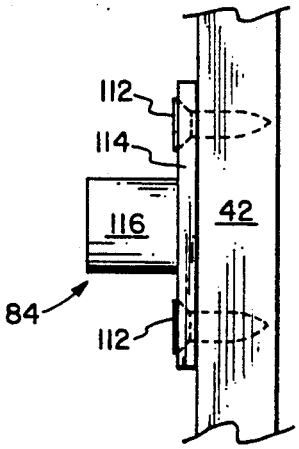
FIG. 3B is a front view of the trip member of FIG. 3A.

Referring now to FIGS. 3A and 3B, there is shown in detail, a trip member 84, located on surface 42 of drawer 26 and includes oval-shaped apertures 110 into which fasteners 112 are inserted to attach trip member 84 to drawer panel 42. The shape of apertures 110 permits trip member 84 to be adjusted as necessary. At the center of base portion 114 is a cylindrical member 116 integrally formed with base 114 and protruding axially outwardly of base 114.

Figure 6:
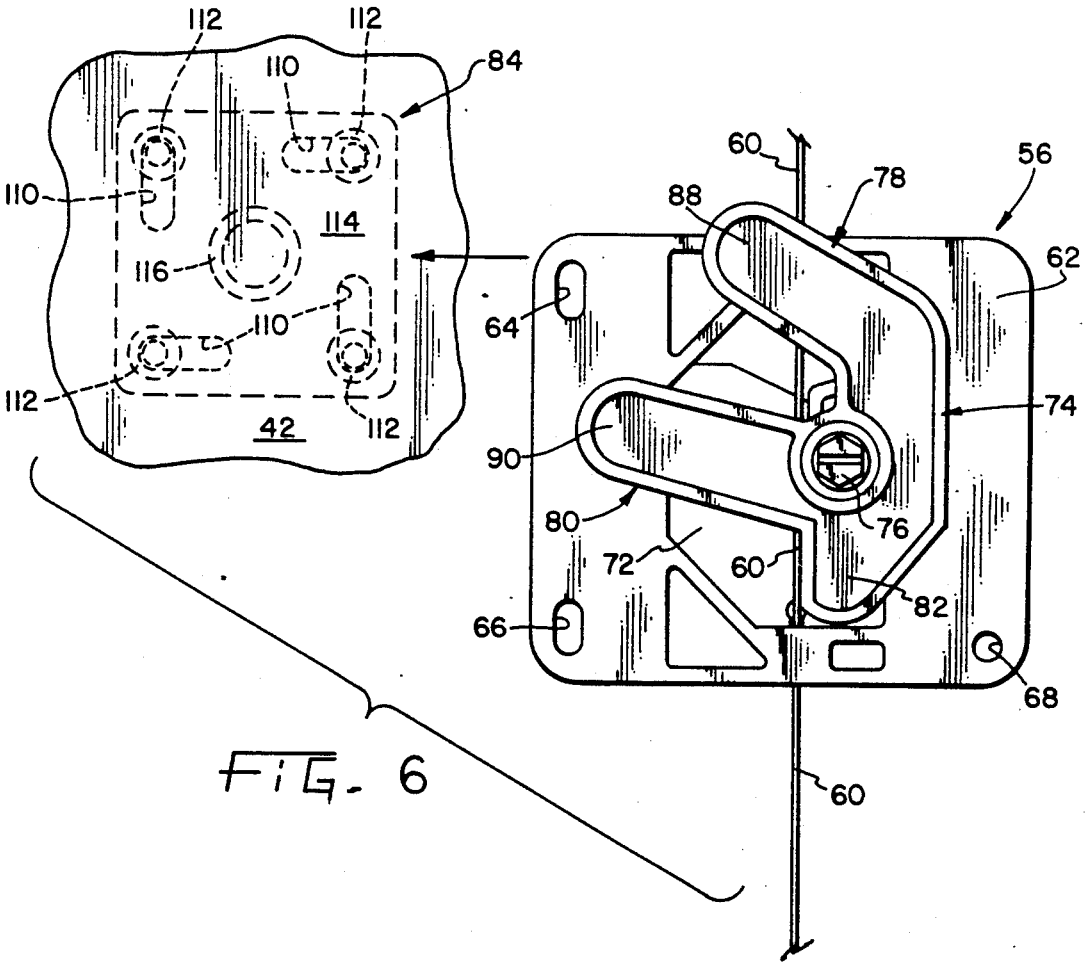
FIG. 6 is an enlarged front view of the camming device and trip member according to the present invention, particularly showing the position of the cam and trip member while an associated cabinet drawer is in a closed position.
Figure 7:
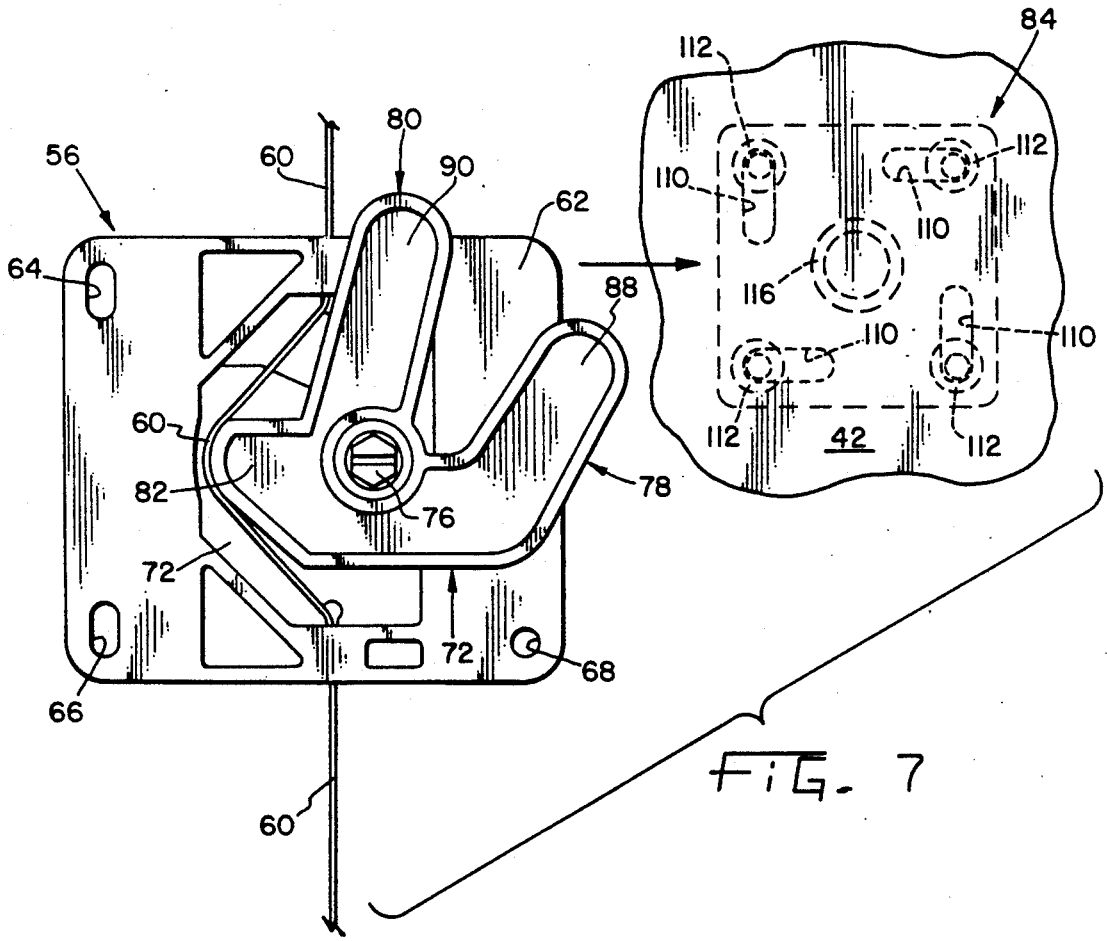
FIG. 7 is a view of the camming device and trip member of FIG. 6 particularly showing the position of the cam and trip member while the associated drawer is in an open position.

Referring now to FIGS. 6 and 7, cam mechanism 56 is shown in detail. Cam mechanism 56 generally comprises a thin rectangular plastic base 62 having apertures 64, 66, and 68 in three of the four corners of base 62 for mounting cam mechanism 56 onto surface 54. A small rectangular block (not shown) is integrally formed with the back surface of base 62. A small channel is formed in the block to guide cable 60 from the top to the bottom of base 62. Base 62 includes an inner recessed area 72 to allow a camming member 74 to rotate therein in line with cable 60. Recessed area 72 is generally in the shape of an arc of between 90° and 120°. A portion of cable 60 that extends through base 62 lies in recessed area 72. Camming member 74, which is pivotally attached to base 62 by pivot pin 76, comprises a leading leg 78 and a trailing leg 80. Legs 78 and 80 extend radially and axially beyond recessed area 72, and neither leg engages cable 60. A cable contacting portion 82 of camming member 74 is generally housed within recessed area 72 and makes contact with that portion of cable 60 also in recessed area 72.

As shown in FIG. 6, cam mechanism 56 is in its closed position. More specifically, cam mechanism 56 is in such a position when drawer 26 is closed. When drawer 26 is opened, protruding cylindrical member 116 of trip member 84, which is mounted on drawer panel 42 in the path of cam mechanism 56, engages tip 88 of leading leg 78 and rotates leading leg 78 in a clockwise direction until camming member 74 is rotated to the position shown in FIG. 7. As camming member 74 rotates, cable contacting portion 82 engages cable 60 and takes up the slack in the cable. In this position, cable 60 is in a taut position, and therefore none of the other drawers in cabinet 10 can be opened. If a second drawer, such as drawer 28 is attempted to be opened, trip member 86 of drawer 28 will engage tip 88' of leading leg 78' (FIG. 3). However, cable contacting portion 82' will not rotate since there is no available slack left in cable 60. Since cable contacting portion 82' will not allow camming member 74' to rotate, trip member 86 will not move beyond tip 88', thus preventing drawer 28 from being opened. Thus, as long as one drawer is in an open position, none of the other drawers may be opened.

When drawer 26 is moved horizontally back to its closed position, cylindrical member 116 will engage tip 90 of trailing leg 80 and will rotate camming member 74 counterclockwise back to its original position as shown in FIG. 6. The cable will again return to its slack position to allow any other drawer to be opened.

If two drawers, such as drawers 26 and 28 are attempted to be opened at the same time, neither drawer can be opened since there is not enough slack in cable 60 to permit camming members 74 and 74' to rotate sufficiently to allow the engaging members 84 and 86 to clear respective leading legs 88 and 88'. Furthermore, if drawers 26 and 28 are attempted to be opened at the same time, both drawers will be allowed to close again since the force of taut cable 60 will snap cable contacting portions 82 and 82' back into their original positions as shown in FIG. 6.

Figure 4:
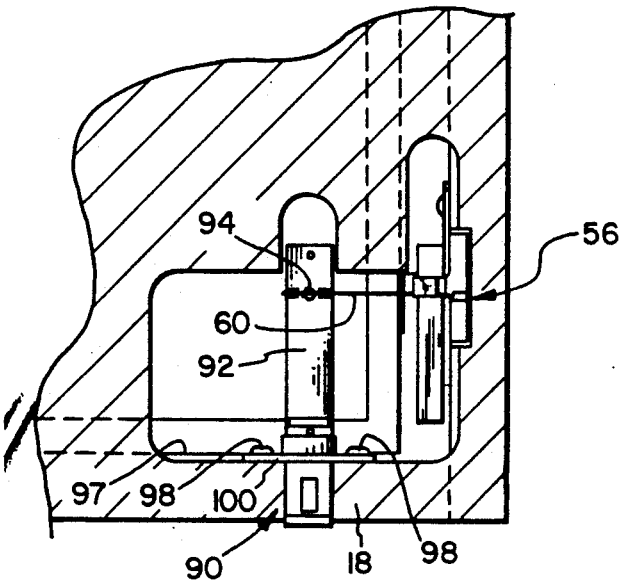
FIG. 4 is an enlarged fragmentary top sectional view of the cabinet of FIG. 1, particularly showing a remote locking device.
Figure 5:
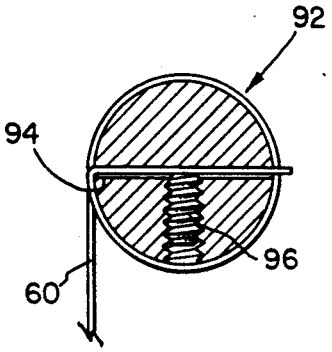
FIG. 5 is an enlarged front isolated view of the locking cylinder and the cable attached thereto, according to the present invention.

Referring now to FIG. 3, there is shown a remote locking mechanism 90 located at the top of cabinet 10 for locking all the drawers in the cabinet, such as for security purposes. Locking mechanism 90 includes a cylinder 92 having an aperture 94 therein into which is threaded one end of cable 60. As shown in FIG. 5, cable 60 extends through cylinder 92 and is restrained within cylinder 92 by set screw 96. Remote locking mechanism 90 is secured to inner surface 97 of front panel 18 by fasteners 98 which extend through mounting plate 100, as shown in FIG. 4. Remote locking mechanism 90 may be additionally or alternatively secured to inner surface 54 of side panel 16.

The front edge of cylinder 92 includes a key hole 102 to receive a key for selectively rotating cylinder 92. Upon insertion of a key into key hole 102 and rotation of the key, cylinder 92 is rotated, which wraps cable 60 around cylinder 92 until cable 60 is taut. Once cable 60 is taut, none of the drawers in cabinet 10 may be opened for the reasons previously explained. When it is desired to unlock the drawers, cylinder 92 is rotated in the opposite direction to allow cable 60 to become slack so that a drawer may be opened. In this manner, all but one drawer may be locked using the interlock means which prevents more than one drawer from being opened from the cabinet at any one time. Furthermore, all the drawers may be locked in their closed positions by locking mechanism 90 as a security measure. In each of these cases, the same cable is used for stopping the outward movement of the drawers.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cabinet comprising:

at least two drawers, each having a closed position and an open position;

cable means extending adjacent each said drawer for preventing outward movement of said drawer, said cable means being movable between a slack position to allow outward movement of any one of said drawers and a taut position to prevent outward movement of any of said drawers;

engaging means associated with each of said drawers for engaging and moving said cable means from said slack position to said taut position upon outward movement of one of said drawers, whereby only one drawer may be in said open position at any one time; and remote locking means attached to said cable means for selectively moving said cable means between said slack position and said taut position while each said drawer is in said closed position.

2. The cabinet of claim 1, wherein said engaging means includes a cam means for moving between a first position and a second position, said cam means being attached to each cabinet adjacent each said drawer and engaging said cable means, said engaging means further including a trip member attached to each of said drawers and in the path of an associated cam means to move said cam means from said first position to said second position upon outward movement of one of said drawers.

3. The cabinet of claim 2, wherein said cam means comprises at least a first cam arm, said trip member engaging said first cam arm upon outward movement of said drawer to move said cam means, the rotation of said cam means pulling said cable means taut.

4. The cabinet of claim 3, wherein said cam means comprises a second cam arm, said trip member engaging said second cam arm upon inward movement of said drawer to move said cam means in a direction opposite to the direction of rotation caused by the engagement of said first cam arm.

5. The cabinet of claim 4, wherein said cam means comprises a third cam arm, which engages and pulls said cable means taut upon rotation of said cam means between said first position and said second position.

6. The cabinet of claim 5, wherein said cable means extends laterally behind said first cam arm and said second cam arm and in the path of said third cam arm.

7. The cabinet of claim 3, wherein said trip member includes a protruding cylindrical member, which engages said first cam arm upon outward movement of said drawer.

8. The cabinet of claim 1, wherein said remote locking means comprises a rotating cylinder operated by use of a key or combination lock, one end of said cable means being attached to said cylinder so that, upon rotation of said cylinder, a portion of said cable means is wound around said cylinder to pull said cable means into said taut position.

9. The cabinet of claim 8, wherein a keyhole is located in one end of said cylinder, and upon insertion and rotation of a key into said keyhole, said cylinder is rotated.

10. The cabinet of claim 1, wherein said cable means is a flexible stainless steel wire cable.

11. A cabinet comprising:

at least two drawers;

rotatable lever means attached to the cabinet adjacent each drawer, each said lever means rotatable between a first position and a second position, said lever means blocking movement of its respective said drawer when in its first position;

a trip member attached to each of said drawers for engaging and moving a respective said lever means between said first position and said second position upon outward movement of the respective said drawer;

a flexible cable means mounted on said cabinet adjacent said lever means, said cable means being moveable between a slack position to allow rotation of any one of said lever means to its second position and a taut position to prevent subsequent rotation of any of said lever means to its second position;

each said lever means engageable with said cable means whereby movement of one of said lever means from said first position to said second position pulls said cable means from said slack position to said taut position to allow only one drawer to be opened at any one time; and remote locking means attached to said cable means for selectively moving said cable means between said slack position and said taut position while each said lever means is in said first position.

12. The cabinet of claim 11, wherein said rotatable lever means comprises at least a first lever, said trip member engaging said first lever upon outward movement of said drawer to move said lever means, the rotation of said lever means pulling said cable means taut.

13. The cabinet of claim 12, wherein said lever means comprises a second lever, said trip member engaging said second lever upon inward movement of said drawer to move said lever means in a direction opposite to the direction of rotation caused by the engagement of said first lever.

14. The cabinet of claim 13, wherein said lever means comprises a third lever which engages and pulls said cable means taut upon rotation of said cable means between said first position and said second position.

15. The cabinet of claim 14, wherein said cable means extends laterally behind said first lever and said second lever and in the path of said third lever.

16. The cabinet of claim 12, wherein said trip member includes a protruding cylindrical member, which engages said first lever upon outward movement of said drawer.

17. The cabinet of claim 11, wherein said remote locking means comprises a rotatable cylinder, one end of said cable means being attached to said cylinder so that, upon rotation of said cylinder, a portion of said cable means is wound around said cylinder to pull said cable means into said taut position.

18. The cabinet of claim 17, wherein a keyhole is located in one end of said cylinder, and upon insertion and rotation of a key into said keyhole, said cylinder is rotated.

19. In a cabinet having at least two drawers, a combination lock and interlock assembly comprising:

a cam operatively attached to a cabinet adjacent each drawer, said cam being moveable between a first position and a second position, said cam including a cable engaging portion and a drawer engaging portion;

a trip member attached to each said drawer and engaging a respective said drawer engaging portion and moving said cam from said first position to said second position as one of said drawers is opened, said trip member disengaging said drawer engaging portion as said cam reaches said second position to allow said drawer to freely open;

a cable mounted on said cabinet adjacent each said cam and moveable between a slack position and a taut position, each said cam being prevented from movement from said first position to its said second position when said cable is in its taut position;

said cable in said second position being moveable only back to said first position thereby preventing more than one of said cams being moved to their said second positions at any one time, whereby only one drawer and trip member can be moved past an associated cam and opened at any one time; and locking means attached to said cable for selectively moving said cable between said slack position and said taut position while each said drawer is in said closed position, said locking means being operated by one of a key or combination lock mechanism.

20. The assembly of claim 19, wherein said cam drawer engaging portion comprises at least a first cam arm, said trip member engaging said first cam arm upon outward movement of said drawer to move said cam, the rotation of said cam pulling said cable taut.

21. The assembly of claim 20, wherein said cam drawer engaging portion comprises a second cam arm, said trip member engaging said second cam arm upon inward movement of said drawer to move said cam in a direction opposite to the direction of rotation caused by the engagement of said first cam arm.

22. The assembly of claim 21, wherein said cable engaging portion comprises a third cam arm, which engages and pulls said cable taut upon rotation of said cam between said first position and said second position.

23. The assembly of claim 22, wherein said cable extends laterally behind said first cam arm and said second cam arm and in the path of said third cam arm.

24. The assembly of claim 20, wherein said trip member includes a protruding cylindrical member, which engages said first cam arm upon outward movement of said drawer.

25. The assembly of claim 19, wherein said locking means comprises a rotating cylinder, one end of said cable being attached to said cylinder so that, upon rotation of said cylinder, a portion of said cable is wound around said cylinder to pull said cable into said taut position.

26. The cabinet of claim 25, wherein a keyhole is located in one end of said cylinder, and upon insertion and rotation of a key into said keyhole, said cylinder is rotated.

* * * * *